United States Patent [19]

Mabuchi

[11] 4,253,013

[45] Feb. 24, 1981

[54] ELECTRIC HEATING DEVICE FOR WARMING THE SHAVING HEAD OF AN ELECTRIC SHAVER

[75] Inventor: Kenichi Mabuchi, Matsudo, Japan

[73] Assignee: Mabuchi Motor Co., Ltd., Tokyo, Japan

[21] Appl. No.: 932,720

[22] Filed: Aug. 11, 1978

[30] Foreign Application Priority Data

Sep. 5, 1977 [JP] Japan ..... 52/119231[U]

[51] Int. Cl.[3] ..... H05B 1/02; H05B 3/02; B26B 2/48

[52] U.S. Cl. ..... 219/521; 30/90; 30/140; 73/363.5; 219/242; 219/419; 219/433; 219/435; 219/442; 219/512

[58] Field of Search ..... 30/140, 90; 73/363.5; 219/521, 242, 520, 436, 432, 438, 433, 441, 442, 535, 415–419, 512, 435

[56] References Cited

U.S. PATENT DOCUMENTS

| | | | |
|---|---|---|---|
| 1,060,267 | 4/1913 | Lamb | 219/436 |
| 1,550,334 | 8/1925 | Baxter | 219/521 X |
| 1,743,301 | 1/1930 | Wolcott | 219/535 X |
| 1,917,305 | 7/1933 | Johnson | 219/521 X |
| 2,541,218 | 2/1951 | Doerr | 219/436 |
| 2,562,821 | 7/1951 | Rothweiler | 219/242 X |
| 2,573,686 | 11/1951 | Blinn et al. | 73/363.5 X |
| 3,010,006 | 11/1961 | Schwaneke | 219/442 |
| 3,415,712 | 12/1968 | Barker | 73/363.5 X |
| 3,752,155 | 8/1973 | Blinoff et al. | 219/242 UX |

FOREIGN PATENT DOCUMENTS

| | | | |
|---|---|---|---|
| 208943 | 6/1957 | Australia | 219/419 |
| 463732 | 8/1928 | Fed. Rep. of Germany | 219/242 |
| 597603 | 5/1934 | Fed. Rep. of Germany | 219/521 |
| 478310 | 2/1953 | Italy | 219/433 |
| 486318 | 6/1938 | United Kingdom | 219/438 |
| 609517 | 10/1948 | United Kingdom | 219/521 |

*Primary Examiner*—A. Bartis

[57] ABSTRACT

The shaver warmer of this invention includes a heat transfer portion which almost closely fits the shaver head of the electric shaver to be warmed. A heat supply portion is directly connected to the heat transfer portion and a temperature control portion controls the heating temperature by detecting the temperature of the heat transfer portion. The shaving head of the electric shaver can thereby be heated to a predetermined temperature in a relatively short time so that advantage may be taken of the relatively large thermal capacity of the shaving head of an electric shaver.

2 Claims, 4 Drawing Figures

ELECTRIC HEATING DEVICE FOR WARMING THE SHAVING HEAD OF AN ELECTRIC SHAVER

BACKGROUND OF THE INVENTION

1. Field of the Invention

This invention relates generally to a shaver warmer, and specifically to a shaver warmer for heating one or more shaving heads of electric shavers to a predetermined temperature with one or more heat transfer portions having a shape that almost closely fits to the contour of the shaving heads.

2. Description of the Prior Art

In shaving, a hot, steamed towel is often placed on the face to expand the pores of the skin and soften the beard so as to ensure comfortable shaving. The use of a steamed towel, however, has many troublesome problems since it takes much time to steam a towel and the towel cools down in a relatively short time due the evaporation of water. As a simple method to achieve the same effect, a razor or an electric shaver is heated by immersing in hot water. This method has also a drawback in that the heated razor or electric shaver rapidly cools down due the evaporation of water, which takes away the heat.

This invention is intended to obviate the aforementioned drawbacks by heating the shaving head of an electric shaver to an appropriate temperature without using hot water, taking advantage of the relatively large thermal capacity of the shaving head of an electric shaver.

SUMMARY OF THE INVENTION

The present invention provides a shaver warmer that includes a plurality of separate, spaced apart cup-shaped members each of which has a resin coated vertical shaving head support wall and a horizontal bottom wall. The cup-shaped members are sized and shaped so as to substantially closely fit the shaving head of a shaver. There is also provided a plate-like heat supply portion that is in heat transfer contact with the entire bottom wall of each cup-shaped member in order to supply thermal energy thereto. The heat supply portion on which the cup-shaped members are directly placed comprise the heating wire, two heat resistant, electrically insulating plates between which the heating wire is interposed and a planar metallic heat transfer plate that is positioned between one of the insulating plates and the bottom wall of each of the cup-shaped members. The shaving head that rests on the bottom wall of the cup-shaped member is heated by the cup-shaped member which, in turn, is heated by the heat supply portion. There is also included in the present invention a temperature control means that is responsive to the temperature of the heat transfer plate for controlling the supply of thermal energy from the heat supply portion to the cup-shaped members in order to maintain the temperature of the cup-shaped members within a predetermined temperature range. The temperature control means includes a temperature sensing element which is mounted in direct contact with the metallic heat transfer plate in order to control the temperature of the cup-shaped members by detecting the temperature of the heat transfer plate.

DETAILED DESCRIPTION OF THE EMBODIMENT

Figure 1:
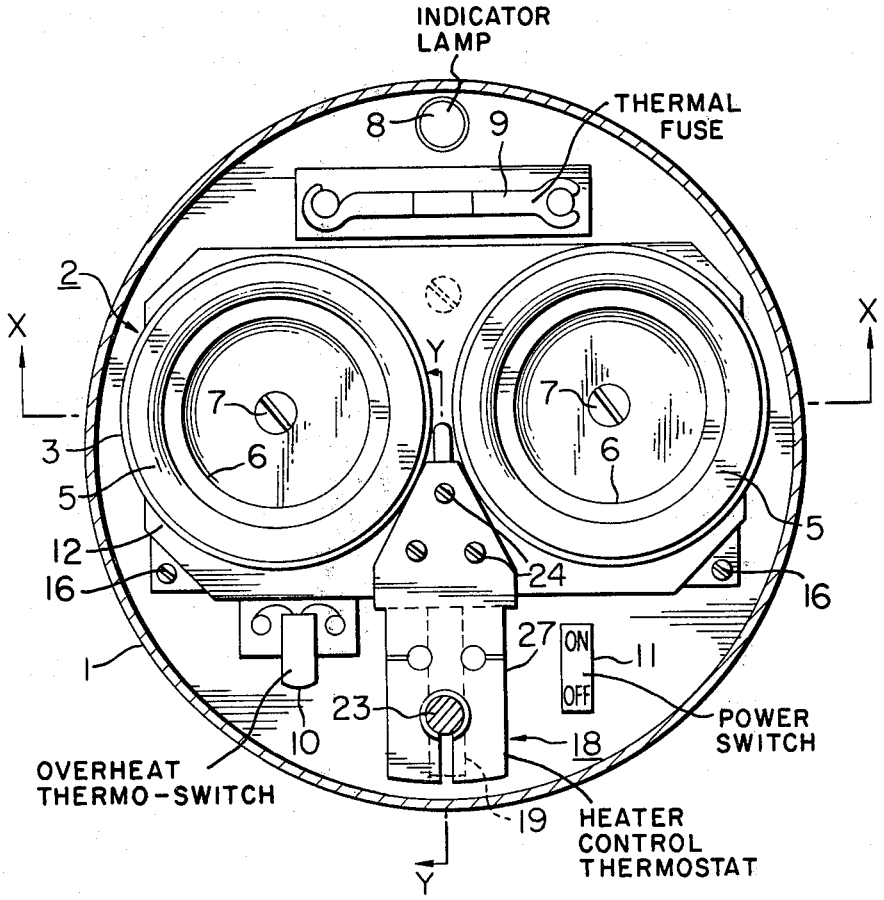
FIG. 1 is a top view of a shaver warmer embodying this invention with the upper part of the casing broken away.
Figure 2:
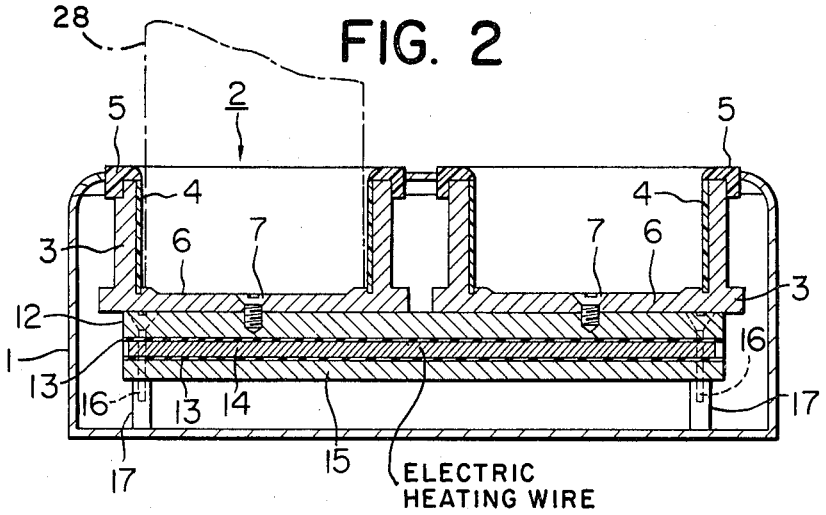
FIG. 2 is a longitudinal section in elevation taken along the line X-X in FIG. 1.
Figure 3:
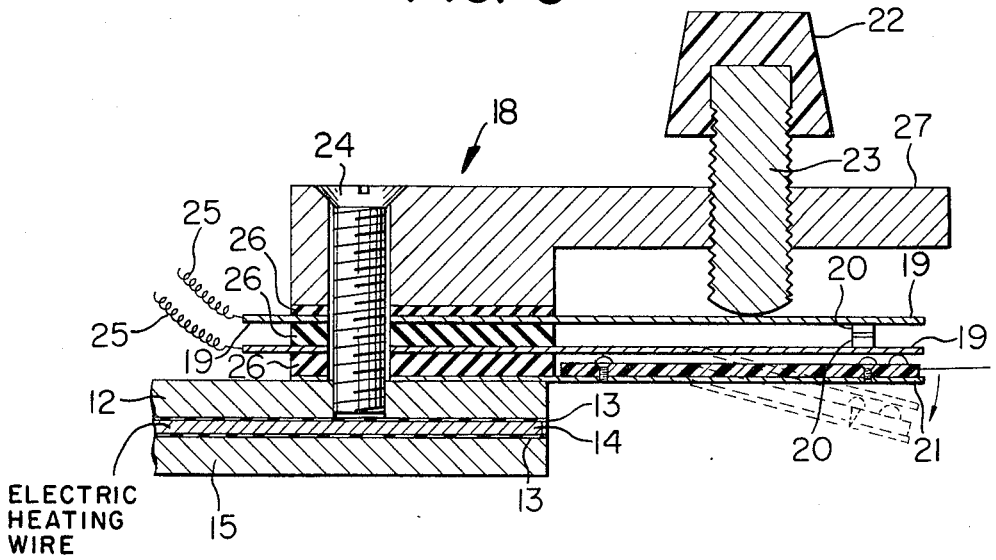
FIG. 3 is a longitudinal section in elevation of the temperature control portion thereof taken along the line Y-Y in FIG. 1.

As is apparent from FIGS. 1 and 2, a shaver warmer embodying this invention has a heat transfer portion 2 which protrudes slightly from the upper surface of a cylindrical casing 1. The heat transfer portion 2, which is made of aluminum, has one or more heating cylinders 3 that almost closely fit to the shaving heads of electric shavers 28. Inside the heating cylinders 3, a resin coating 4 such as acetal resin is applied. The upper edge of the heating cylinder 3 is covered with a plastic protector cover 5. A recess 6 is provided on the bottom surface of the heating cylinder 3 so as to ensure good contact with the outer surface of the shaving head. Consequently, the shaving head is contained within the heating cylinder 3 while maintaining good contact with the bottom surface 6 of the heating cylinder 3. The heating cylinder 3 may not be coated with a resin coating 4. The heat transfer portion 2 is fixed to an aluminum heat transfer plate 12 below the heating cylinder 3 with a screw 7. A heating element 14 of approximately 30 W made of nichrome wire interposed between mica plates 13 and 13 is positioned between an aluminum base plate 15 and the heat transfer plate 12. These members 13, 14 and 15, together with the heat transfer plate 12, are fixed to support legs 17 with fixing means 16. The support legs are integrally fixed to the bottom surface of the casing 1 in the form of posts. As a result, a space is formed between the aluminum base plate 15 and the bottom of the casing 1, and surplus heat from the heating wire 14 is radiated to the space. Since a temperature control portion 18 is directly fixed to the heat transfer plate 12 by support screws 24, as shown in FIGS. 1 and 3, the heat generated in the heating wire 14 is transferred directly to the temperature control portion 18. The temperature control portion 18 has such a construction that contact springs 19 and 19 are interposed in parallel between insulators 26 and 26 so that contacts 20 and 20 are normally kept in contact with each other. A bimetal 21 which operates to break the contacts 20 and 20 when the temperature rises to a predetermined value is provided on the lower part of either of the contact springs 19 and 19. The bimetal 21 is comprised of a combination of a high impact styrol plate and a phosphor bronze plate, for example, which are laminated or otherwise suitable secured to each other by any means such as an adhesive or screws. A support member 27 through which the shaft 23 extends has a portion which is secured to the heat transfer plate 12 by the screws 24. The temperature at which the contacts 20 and 20 break is adjustable by an adjusting knob 22 and shaft 23 over the range of 40°–60° C. The temperature control range, which is as low as 40°–60° C., permits the use of resin material for a part of the bimetal 21, thus making it possible to lower the manufacturing cost of the bimetal 21. A safety fuse 9 having an operating temperature of 80° C. and a thermo-switch 10 for preventing overheat respond to the air temperature in the casing 1 and are provided on the base wall of the heating chamber 3 together with an indicating lamp 8. That is to say, triple overheat protection is provided in this invention.

Figure 4:
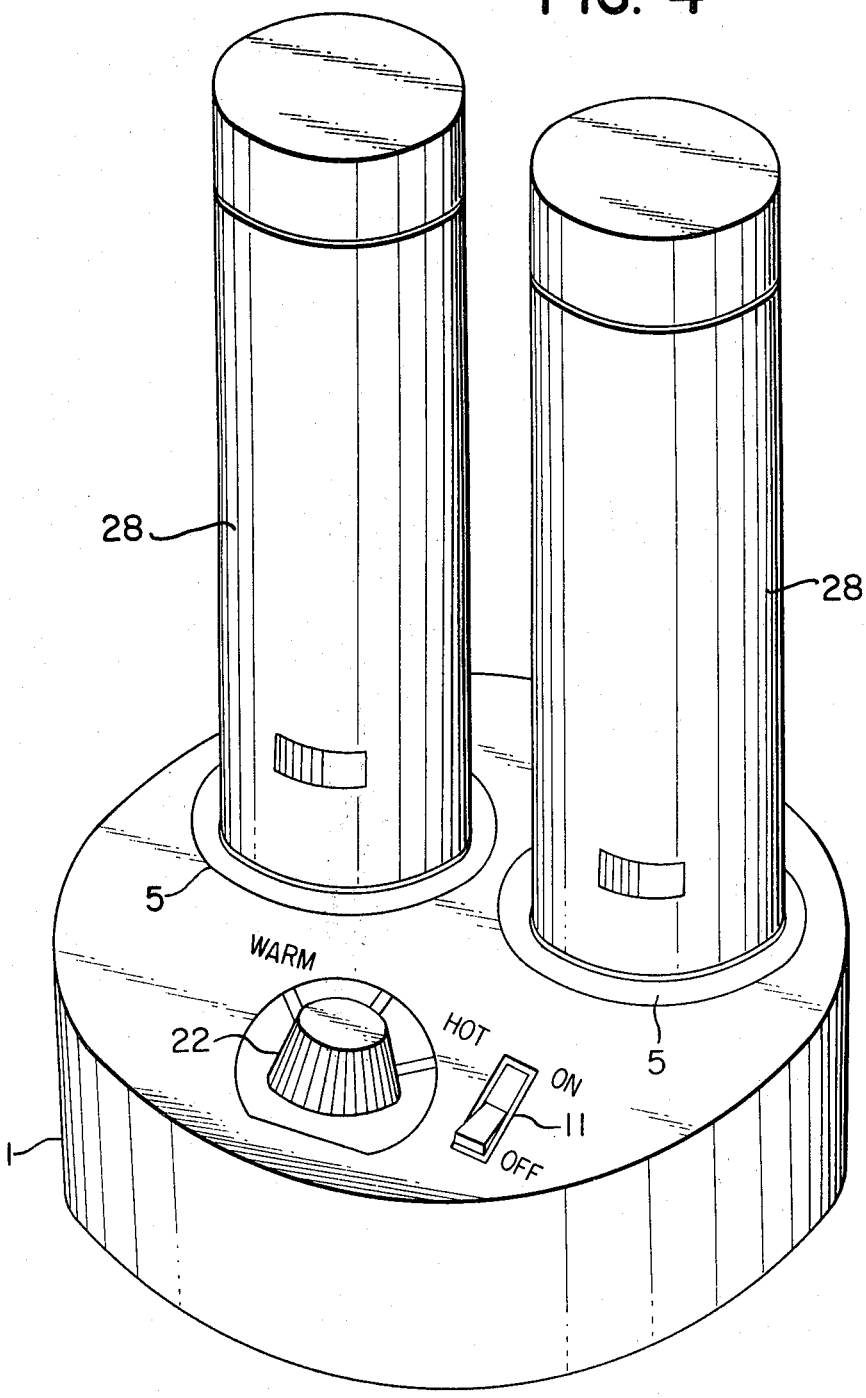
FIG. 4 is a perspective view illustrating how electric shavers are placed on a shaver warmer embodying this invention.

When the shaving heads of electric shavers 28 are placed in the heating cylinders 3 and 3 of the heat transfer portion 2, as shown in FIG. 4, and the power switch 11 is turned on, current flows through the lead wire 25 to the heating wire 14. The heat generated in the heating wire 14 is transferred to the heating cylinders 3 via the heat transfer plate 12. Thus, the shaving heads that rest on the base wall of the heating cylinders 3 are heated and maintained at a preset temperature in the range of 40°-60° C.

When shaving the face using the electric shaver heated in this way, the pores of the skin to which the shaving head is applied are expanded and the beard is softened by the heat, thus a clean and deep shave can be achieved. Furthermore, the shaver edge, when heated, cuts gently without irritating the skin.

Since the temperature of the heated shaving head can be maintained for four to five minutes, shaving of the entire face can be completed within that span of time. The heating cylinder 3 can be formed in a shape that fits the shape of the shaving head of the electric shaver to be used. In addition, the blade of a razor (a Japanese-type razor, for example) can also be heated with this shaver warmer instead of the shaving head of an electric shaver. Although aluminum is used as a heat conducting material in this embodiment, other suitable metals having good heat conductivity can be used.

As described in the foregoing, the shaver warmer of this invention having a heat transfer portion which almost closely fits to the shaving head, a heat supply portion directly connected to the heat transfer portion, and a temperature control portion eliminates the use of steamed towel and other means to steam the beard, and is capable of heating the shaving head to a predetermined temperature in a short time merely by placing the shaving head in the heating cylinder. Therefore, when the shaving head thus heated is applied to the face, the pores of the skin are expanded and the beard is softened, and a clean and deep shave can be accomplished while maintaining a gentle touch to the skin.

When a shaving lotion is used in shaving, the heat of the heated shaving head permits the lotion to penetrate into the skin and spread uniformly over the face, enhancing the effect of the lotion to protect the skin. This eliminates the need for application of the lotion after shaving, ensuring more efficient shaving.

What is claimed is:

1. A shaver warmer comprising a plurality of separate, spaced apart cup-shaped members, each defined by a vertical, resin coated shaving head support wall and a horizontal bottom wall, each of said cup-shaped members being of a size and shape as to substantially closely fit the shaving head of a shaver for supporting and heating the shaving head of the shaver, a plate-like heat supply portion in heat transfer contact with the entire bottom wall of each of said cup-shaped members for supplying thermal energy thereto, the cup-shaped member being placed directly on the heat supply portion, said heat supply portion being comprised of a heating wire, two heat resistant, electrically insulating plates between which the heating wire is interposed and a planar, metallic heat transfer plate interposed between one of the insulating plates and the bottom wall of each of said cup-shaped members, said metallic plate directly contacting the bottom wall of each cup-shaped member to supply heat thereto, each cup-shaped member heated by the heat supply portion being adapted to heat the shaving head resting on the bottom wall of the cup-shaped member, and a temperature control means responsive to the temperature of the heat transfer plate controlling the supply of thermal energy from the heat supply portion to the cup-shaped members to maintain the temperature of the cup-shaped members in a predetermined temperature range, the temperature control means including a temperature control sensing element mounted in direct contact with said metallic heat transfer plate for controlling the temperature of said cup-shaped members by detecting the temperature of the heat transfer plate.

2. A shaver warmer as set forth in claim 1 wherein the temperature control means includes contacts that are electrically connected to be heating wire and the temperature sensing element comprises a bimetal for making and breaking the contacts, the bimetal being comprised of a resin plate and a metal plate that are secured to each other.

* * * * *